US006464209B2

(12) United States Patent
Meis et al.

(10) Patent No.: US 6,464,209 B2
(45) Date of Patent: Oct. 15, 2002

(54) FENCE GATE

(76) Inventors: William J. Meis, 23590 Old Lincoln Hwy.; Robert W. Yard, 17111 Limekiln Rd., both of Crescent, IA (US) 51526

( * ) Notice: Subject to any disclaimer, the term of this patent is extended or adjusted under 35 U.S.C. 154(b) by 0 days.

(21) Appl. No.: 09/729,327

(22) Filed: Dec. 4, 2000

(65) Prior Publication Data

US 2002/0066898 A1 Jun. 6, 2002

(51) Int. Cl.[7] ..... E04H 17/16
(52) U.S. Cl. ..... 256/73; 256/65.03; 256/67
(58) Field of Search ..... 256/73, 24, 25, 256/26, 27, 21, 22, 19, 67, 60, 59, 69, DIG. 2; 160/371, 372, 377; 49/236, 240, 381, 389

(56) References Cited

U.S. PATENT DOCUMENTS

| | | | | | |
|---|---|---|---|---|---|
| 11,315 | A | | 7/1854 | Walker, Sr. | |
| 194,724 | A | | 8/1877 | Reed et al. | |
| 236,971 | A | * | 1/1881 | Bahnson | 256/73 X |
| 346,644 | A | | 8/1886 | Crisp | |
| 438,987 | A | | 10/1890 | Coffman | |
| 444,960 | A | | 1/1891 | Priday | |
| 454,677 | A | * | 6/1891 | Braden | 256/DIG. 2 X |
| 1,633,619 | A | * | 6/1927 | Ward | 256/26 |
| 1,954,256 | A | | 1/1934 | Nelson | 256/19 |
| 2,835,475 | A | * | 5/1958 | Enghauser | 256/22 |
| 3,067,985 | A | * | 12/1962 | Cusack | 256/22 |
| 3,101,929 | A | * | 8/1963 | Dvore | 256/24 |
| 3,290,014 | A | * | 12/1966 | Stapleton | 256/73 |
| 4,883,256 | A | | 11/1989 | Hebda | 256/22 |
| 5,161,783 | A | | 11/1992 | German | 256/19 |
| 5,190,268 | A | * | 3/1993 | Espinueva | 256/67 |
| 5,558,312 | A | * | 9/1996 | Brennan | 256/65 |
| 5,716,041 | A | * | 2/1998 | Groves | 256/73 |

FOREIGN PATENT DOCUMENTS

| | | | | |
|---|---|---|---|---|
| CA | 599175 | * | 5/1960 | 256/67 |

* cited by examiner

*Primary Examiner*—Lynne H. Browne
*Assistant Examiner*—John R. Cottingham
(74) *Attorney, Agent, or Firm*—Thomte, Mazour & Niebergall; Dennis L. Thomte

(57) ABSTRACT

A gate is disclosed for positioning between a hinge post and a latch post. The gate comprises horizontally spaced-apart end members which are channel-shaped. Each of the end members has a base portion and spaced-apart side walls extending therefrom. A plurality of metal rail members are initially secured to and extend between the end members by means of pivot bolts. When the metal gate has been adjusted to conform to elevational differences between the hinge post and the latch post, the relationship of the rail members and the end members is fixed by means of screws extending through the side walls of the end members into the ends of the rail members.

4 Claims, 4 Drawing Sheets

FENCE GATE

BACKGROUND OF THE INVENTION

1. Field of the Invention

This invention relates to a fence gate and more particularly to a fence gate which may be adjusted to compensate for elevational differences between the hinge post and the latch post of the fence.

2. Description of the Related Art

Gates are normally provided in fences to permit ingress into and egress from the fenced area. In those cases where the hinge post and the latch post of the fence are at the same elevation, the gate is normally comprised of a pair of vertically disposed end members which have horizontally extending rail members secured thereto and extending therebetween. If the hinge post is at a higher elevation than the latch post, the free end of the gate will not conform to the latch post if the gate is installed so that the end members thereof are vertically disposed and the rail members thereof are horizontally disposed. In the situation described above, the upper end of the free end of the gate may be positioned above the upper end of the latch post. In the situation described above, the lower end of the free end of the gate will be spaced considerably above the ground, thereby creating a space therebelow through which animals may pass. The situation described above makes it impossible to use a pre-fabricated gate. Thus, a gate must be specially fabricated wherein the rail members extend between the hinge post and the latch post at an angle so that the end member at the free end of the gate will be positioned lower than the end member at the hinge end of the gate. The fabrication or construction of a gate to match elevational differences between the hinge post and the latch post is difficult and time-consuming. Further, in those cases where the gate is of metal construction, the metal rail members must be welded to the metal end members in the angled position which requires that the welder come to the job site to fabricate the gate. The same problems arise when the latch post is at a higher elevation than the hinge post.

SUMMARY OF THE INVENTION

A metal gate is disclosed for positioning between a hinge post and a latch post. The gate is comprised of a first channel-shaped end member having upper and lower ends and a second channel-shaped end member which is spaced from the first end member and which has upper and lower ends. Each of the channel-shaped end members comprises a base portion and spaced-apart side walls. A plurality of tubular rail members are secured to the end members and extend therebetween. The ends of the rail members are received between the side walls of the end members and are pivotally secured thereto by means of a pivot bolt. The rail members may be pivotally moved with respect to the end members to enable the gate to conform to elevational differences between the hinge post and the latch post. Once the gate has been positioned in its adjusted configuration, screws are driven through the side walls of the end members into the rail members to maintain the gate in its adjusted position.

It is therefore a principal object of the invention to provide an improved gate assembly.

Still another object of the invention is to provide a gate which may be easily adjusted to conform to elevational differences between the hinge post and the latch post and vice versa.

Still another object of the invention is to provide a metal gate which may be initially connected together at the factory and may be adjusted into the proper position at the job site by simply driving screws through the end members into the ends of the rail members.

Still another object of the invention is to provide a metal gate which is easy to fabricate and to install.

These and other objects will be apparent to those skilled in the art.

DESCRIPTION OF THE PREFERRED EMBODIMENT

Figure 1:
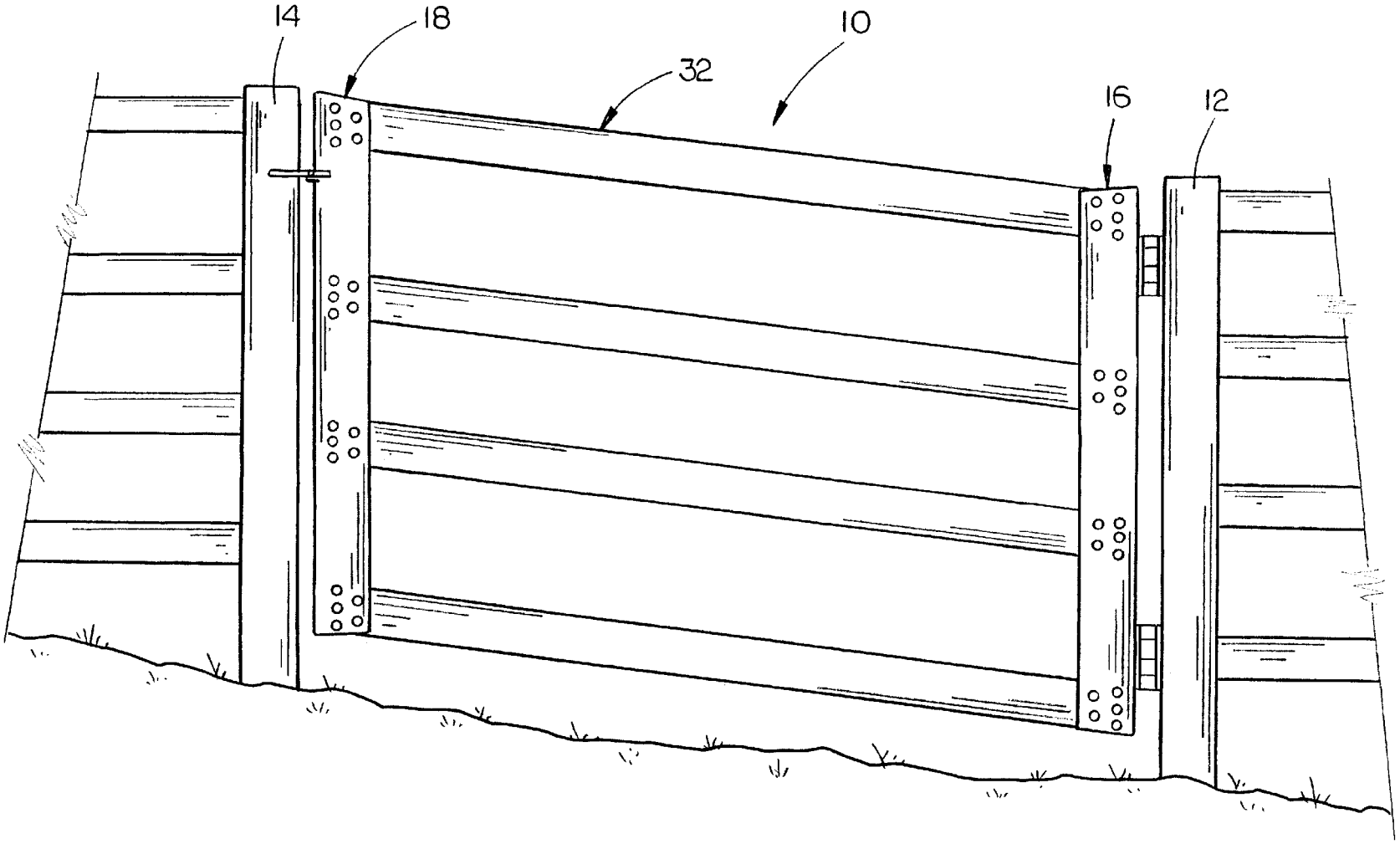
FIG. 1 is a side view of the gate of this invention mounted between a hinge post and a latch post.
Figure 2:
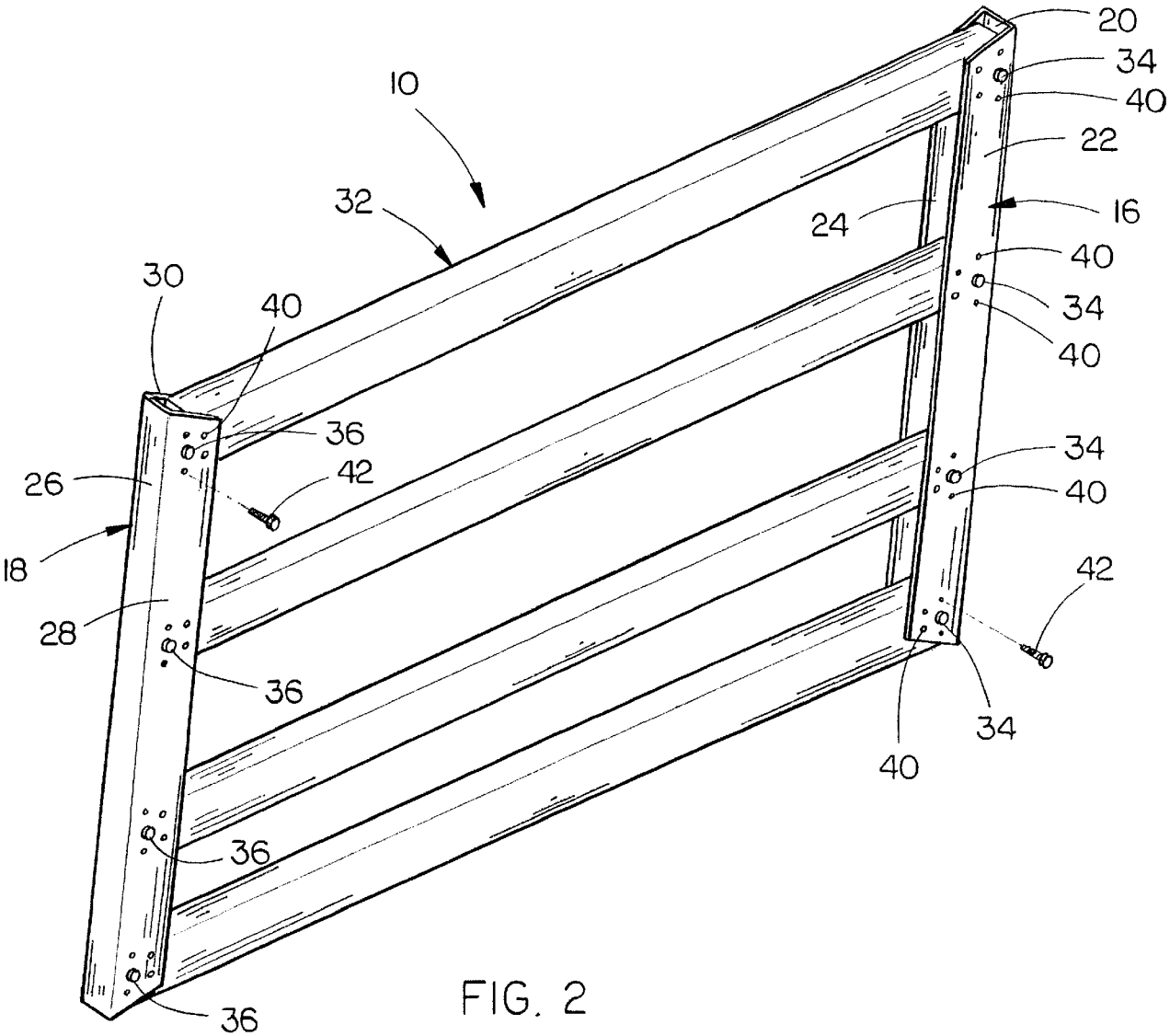
FIG. 2 is a perspective view of the gate of this invention.
Figure 3:
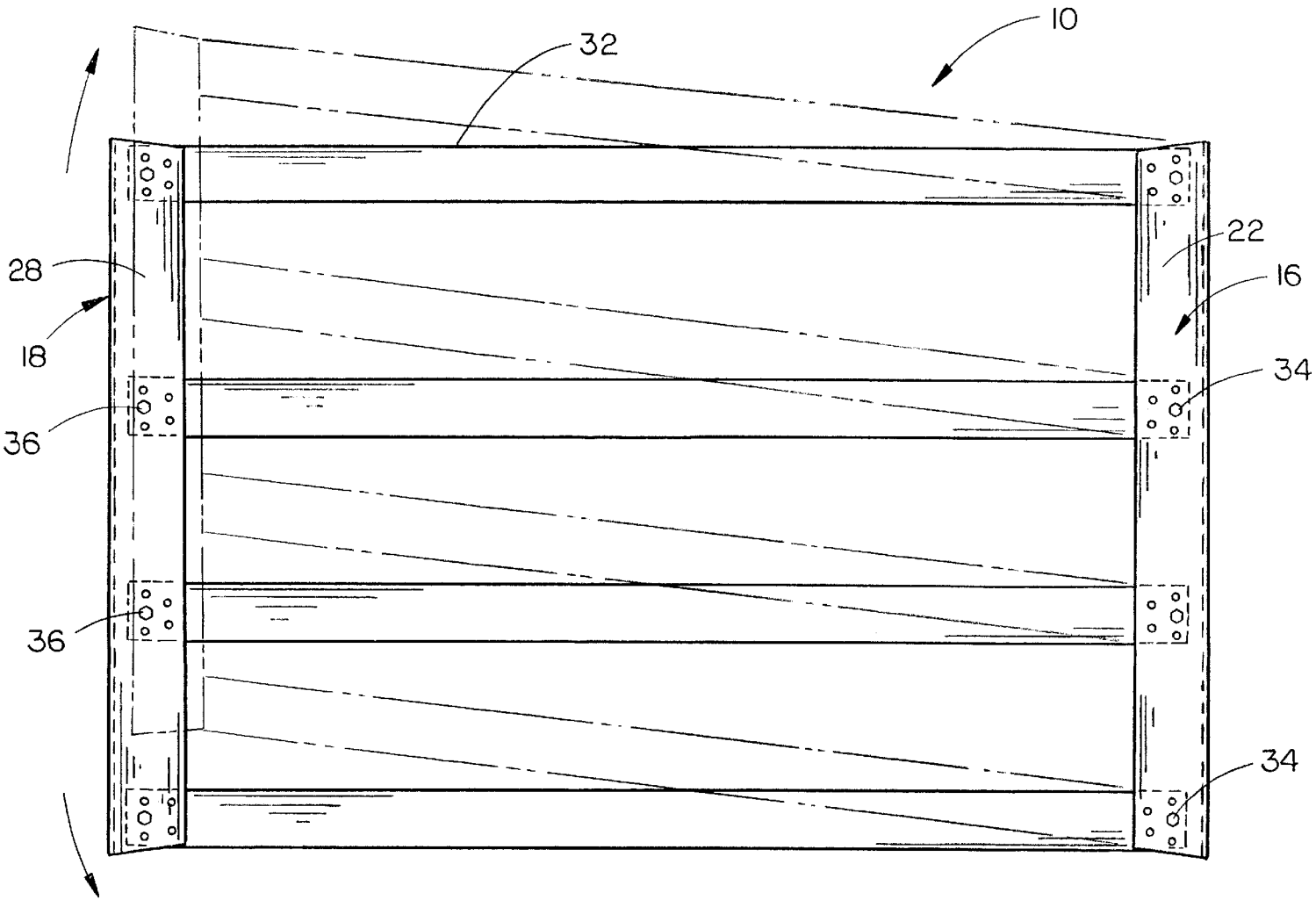
FIG. 3 is a side elevational view of the gate of this invention illustrating the manner in which the gate may be adjusted to conform to elevational differences between the hinge post and the latch post.
Figure 4:
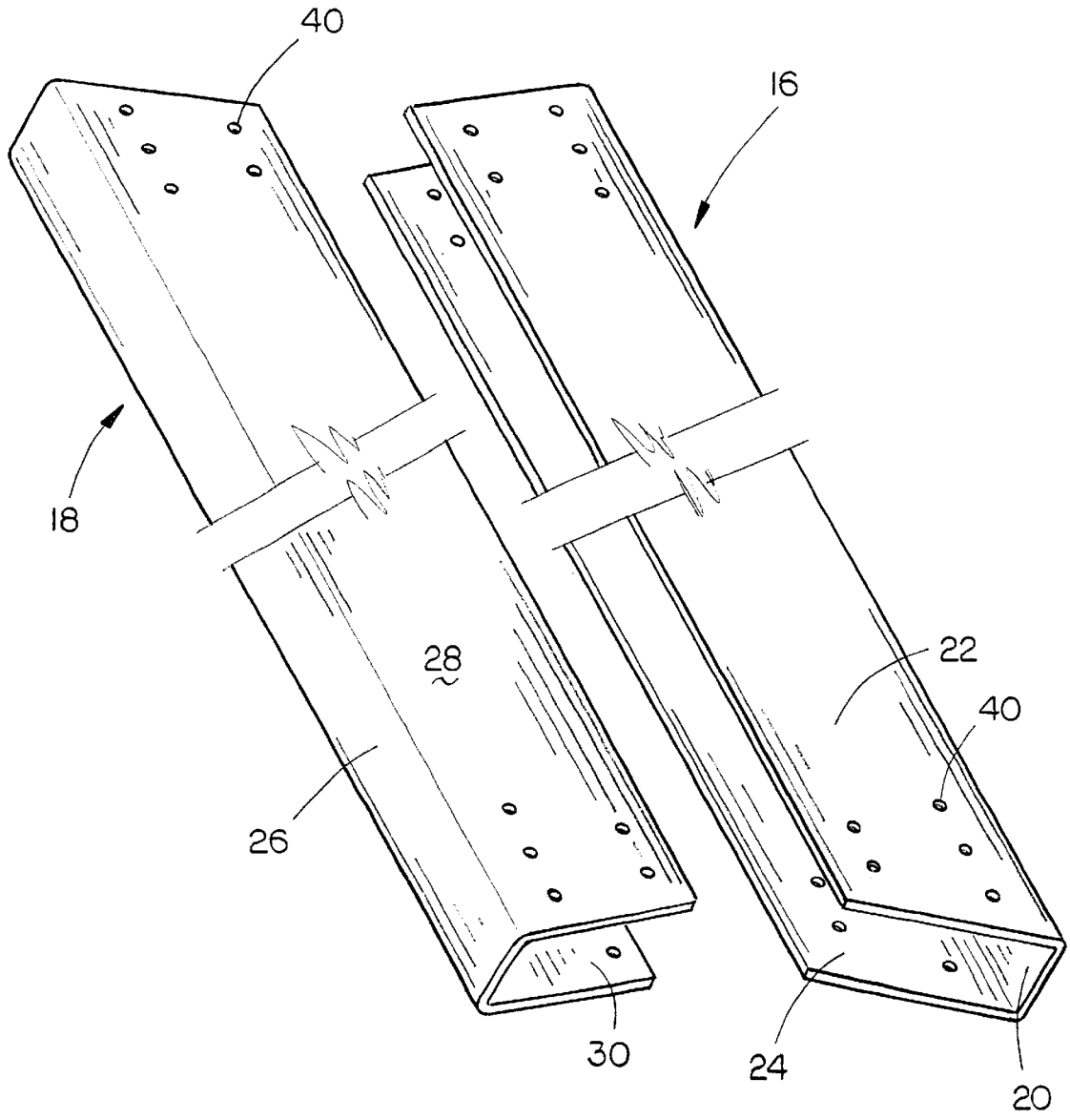
FIG. 4 is an exploded partial perspective view of the end members of the gate.

The gate is this invention is referred to generally by the reference numeral 10 and is designed to be positioned between a hinge post 12 and a latch post 14. Gate 10 is comprised of first and second channel-shaped end members 16 and 18. End member 16 is constructed of metal and includes a base portion 20 and spaced-apart side walls 22 and 24. Similarly, channel-shaped end member 18 includes a base portion 26 and spaced-apart side walls 28 and 30. A plurality of metal tubular rail members 32 are secured to and extend between the end members 16 and 18, as will be described.

One end of each of the rail members 32 is selectively pivotally secured to end member 16 by means of a pivot bolt 34 extending through side portions 22, 24 and rail member 32. The other ends of the rail members 32 are selectively pivotally secured to end member 18 by means of a pivot bolt 36 extending through side portions 28, 30 and rail member 32. As seen in the drawings, the upper ends of side portions 22–24 and 28–30 are tapered downwardly from base portions 20 and 26, respectively. Further, it can be seen in the drawings that the side portions of the end members 16 and 18 are provided with a plurality of openings 40 formed in each of the side portions thereof to enable self-tapping screws 42 or the like to be inserted therethrough into the ends of rail members 32 to maintain the rail members 32 in position with respect to the end members 16 and 18.

The gate will normally be shipped to the job site in a disassembled fashion with the rail members 32 being disconnected from the end members 16 and 18. However, if desired, the pivot bolts 34 and 36 could be installed prior to shipment.

Once the rail members 32 have been pivotally secured to the end members 16 and 18 by means of the pivot bolts 34 and 36, end member 16 will be hingedly secured to hinge post 12 in conventional fashion with the end member 16 being in a vertically disposed condition or in a condition closely parallel post 12. End member 18 will then be raised or lowered with respect to end member 16, which is permitted by the pivot bolts 34 and 36, until the end member 18 is in the proper position relative to the latch post 14. The gate is temporarily maintained in that position by any suitable means and the self-tapping screws 42 are inserted through the openings 40 in the side walls of the end members 16 and 18 to rigidly connect the end members 16 and 18 to the ends of the rail members 32. When the self-tapping screws 42 are installed, the screws 42 will maintain the desired position of the rail members 32 with respect to the end members 16 and 18. At that time, the pivot bolts 34 and 36 may also be tightened if so desired.

It can therefore be seen that a novel gate construction has been provided which enables a gate to be assembled at the job site and to be adjusted so as to readily conform to elevational differences between the hinge post and the latch post.

Thus it can been seen that the invention accomplishes at least all of its stated objectives.

We claim:

1. A fence gate which may be adjusted to compensate for elevational differences between a hinge post and a latch post, comprising:

a first end member having upper and lower ends;

said first end member adapted to be secured to the hinge post;

a second end member horizontally spaced from said first end member and having upper and lower ends;

said second end member adapted to be positioned adjacent the latch post for attachment thereto;

each of said end member being channel-shaped and having a base portion and spaced-apart side walls;

a plurality of elongated, spaced-apart rail members having first and second ends secured to and extending between said first and second end members;

said first ends of said rail members being received between said side walls of said first end member;

said second ends of said rail members being received between said side walls of said second end member;

a pivot bolt selectively pivotally securing each of said first ends of said rail members to said side walls of said first end members;

a pivot bolt selectively pivotally securing each of said second ends of said rail members to said side walls of said second end members;

said pivot bolts permitting the fence gate to be initially adjusted to compensate for elevational differences between the hinge post and the latch post;

a plurality of threaded connection members extending through at least one of said side walls of said first end member into each of said first ends of said rail members;

a plurality of threaded connection members extending through at least one of said side walls of said second end member into each of said second ends of said rail members;

said threaded connection members maintaining the pivot bolt initial adjustment of the fence gate.

2. The fence gate of claim 1 wherein said end members and said rail members are comprised of a metal material.

3. The fence gate of claim 1 wherein said threaded connection members comprise screws extending through each of said side walls of said end members into said ends of said rail members.

4. The fence gate of claim 3 wherein said side walls of said end members have preformed openings formed therein which receive said threaded connection members.

* * * * *